US006220591B1

(12) United States Patent
Stauber

(10) Patent No.: US 6,220,591 B1
(45) Date of Patent: Apr. 24, 2001

(54) APPARATUS FOR PROCESSING FLEXIBLE, SHEET-LIKE PRODUCTS

(75) Inventor: H. Ulrich Stauber, Grüt (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/379,166

(22) Filed: Aug. 23, 1999

(30) Foreign Application Priority Data

Aug. 21, 1998 (CH) ..... 1724/98

(51) Int. Cl.[7] ..... B65H 5/12; B65H 29/06; B65H 5/34; B65H 29/68

(52) U.S. Cl. ..... 271/225; 271/182; 271/277; 271/270; 271/275; 198/483.1

(58) Field of Search ..... 271/182, 225, 271/277, 270, 275; 198/483.1

(56) References Cited

U.S. PATENT DOCUMENTS

| | | | | |
|---|---|---|---|---|
| 3,918,707 | * | 11/1975 | Villemer et al. | 271/277 |
| 4,058,202 | * | 11/1977 | Reist et al. | 198/482 X |
| 4,320,894 | * | 3/1982 | Reist et al. | 271/277 |
| 4,600,186 | | 7/1986 | Von Hein et al. . | |
| 5,169,285 | | 12/1992 | Müller . | |
| 5,224,698 | * | 7/1993 | Kobayashi | 271/270 |
| 5,265,861 | | 11/1993 | Schaffner et al. . | |
| 5,362,043 | * | 11/1994 | Grellman | 271/277 |
| 5,452,886 | | 9/1995 | Cote et al. . | |
| 5,531,433 | * | 7/1996 | Hawkes et al. | 271/10.01 X |
| 5,560,599 | | 10/1996 | Curley et al. . | |
| 5,794,929 | | 8/1998 | Curley et al. . | |
| 6,131,904 | * | 10/2000 | Tomczak | 271/315 X |

FOREIGN PATENT DOCUMENTS

| | | |
|---|---|---|
| 0 499 691 | 8/1992 | (EP) . |
| 1 369 080 | 2/1964 | (FR) . |
| 2 555 938 | 6/1985 | (FR) . |

* cited by examiner

*Primary Examiner*—Christopher P. Ellis
*Assistant Examiner*—Kenneth W Bower
(74) *Attorney, Agent, or Firm*—Alston & Bird LLP

(57) ABSTRACT

An apparatus (10) for conveying flexible sheet-like products wherein a plurality of conveying elements (12) are arranged one behind the other on a rotatable support member in a circular array, and each conveying element comprises a roller segment (24), which is driven continuously in the direction of rotation (D), and a mating element (26), which interacts with the roller segment. In the product receiving region (14), a recess section (44) of the respective roller segment (24) forms, with the mating element (26), an introduction gap (48), of which the leading end is closed. The forward position of the recess section (44) forms a stop (62) for engaging the leading edge (52) of the fed product (19). At about the same time as the leading edge (52) comes into contact with the stop (62), a lateral-surface section (46) following the recess section (44) forms, together with the mating element (26), a conveying gap (54) in which the product (19) is retained in order to be transported further through the conveying element (12).

14 Claims, 3 Drawing Sheets

APPARATUS FOR PROCESSING FLEXIBLE, SHEET-LIKE PRODUCTS

BACKGROUND OF THE INVENTION

The present invention relates to an apparatus for processing flexible, sheet-like products and which is intended for slowing down the products fed to a receiving region of the apparatus and then conveying the products to a transfer region.

An apparatus of this general type is known from EP-B-0 638 503. The apparatus disclosed therein has a decelerating drum which is driven in rotation about its axis and on which there are arranged, at regular intervals one behind the other in the circumferential direction, conveying elements which are formed in each case by a pair of rollers. A feed conveyor introduces a signature sheet tangentially, in relation to the decelerating drum, into the roller gap of the pair of rollers respectively moving through a receiving region. In this case, the speed of circulation of the pair of rollers about the drum axis and the circumferential speed of the rollers oriented in the direction of circulation in the roller gaps are brought into line with the conveying speed of the feed conveyor. The leading edge of the signature sheet is then driven by a desired distance into the roller gap before the rotation of the pairs of rollers about the axes thereof is stopped. In a transfer region, the rollers are then driven in a direction of rotation counter to the direction of rotation in the receiving region, in order to release the relevant signature sheet from the roller gap. This results in the signature sheets being additionally slowed down and makes it possible for the signature-sheet speed to be adapted to the speed of a removal conveyor which receives the signature sheets. The reversing drive of the pairs of rollers, on the one hand, requires considerably outlay and, on the other hand, results in the products being subjected to considerable stressing, which limits the processing capacity of the apparatus.

It is thus an object of the present invention to provide an apparatus of the described type wherein, in the case of a high processing speed, careful handling of the products is ensured.

SUMMARY OF THE INVENTION

The above and other objects and advantages of the present invention are achieved by the provision of an apparatus which has a plurality of conveying elements arranged in a circular array one behind the other on a support member. The support member is rotated about a central axis, so that the conveying elements each move along a circulatory path from a receiving region to a transfer region. Each conveying element includes a continuously driven roller segment and a mating element. The periphery of the roller segment includes at least one circumferentially running surface section and at least one recess section. This configuration, in association with the mating element, forms, during movement through the receiving region, an introduction gap which, for the introduction of a product, has a large width which then decreases continuously and thus stabilizes the product. The leading, closed end of the introduction gap moves in the introduction direction as a result of the rotation of the roller segment, and this contributes to the products being carefully decelerated when they reach the end of the introduction gap. The approximately simultaneous formation of a conveying gap prevents the products from springing back, which contributes to reliable functioning of the apparatus along with a high processing capacity. The continuous driving of the roller segments results in the products being conveyed through the conveying elements, which are formed in each case by the roller segment and the mating element, in order to be discharged in the transfer region. There is thus no need for the products to be slowed down to a standstill, and then accelerated again in relation to the conveying elements.

BRIEF DESCRIPTION OF THE DRAWINGS

The invention is explained in more detail with reference to several exemplary embodiments illustrated in the accompanying drawings, in which, purely schematically.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
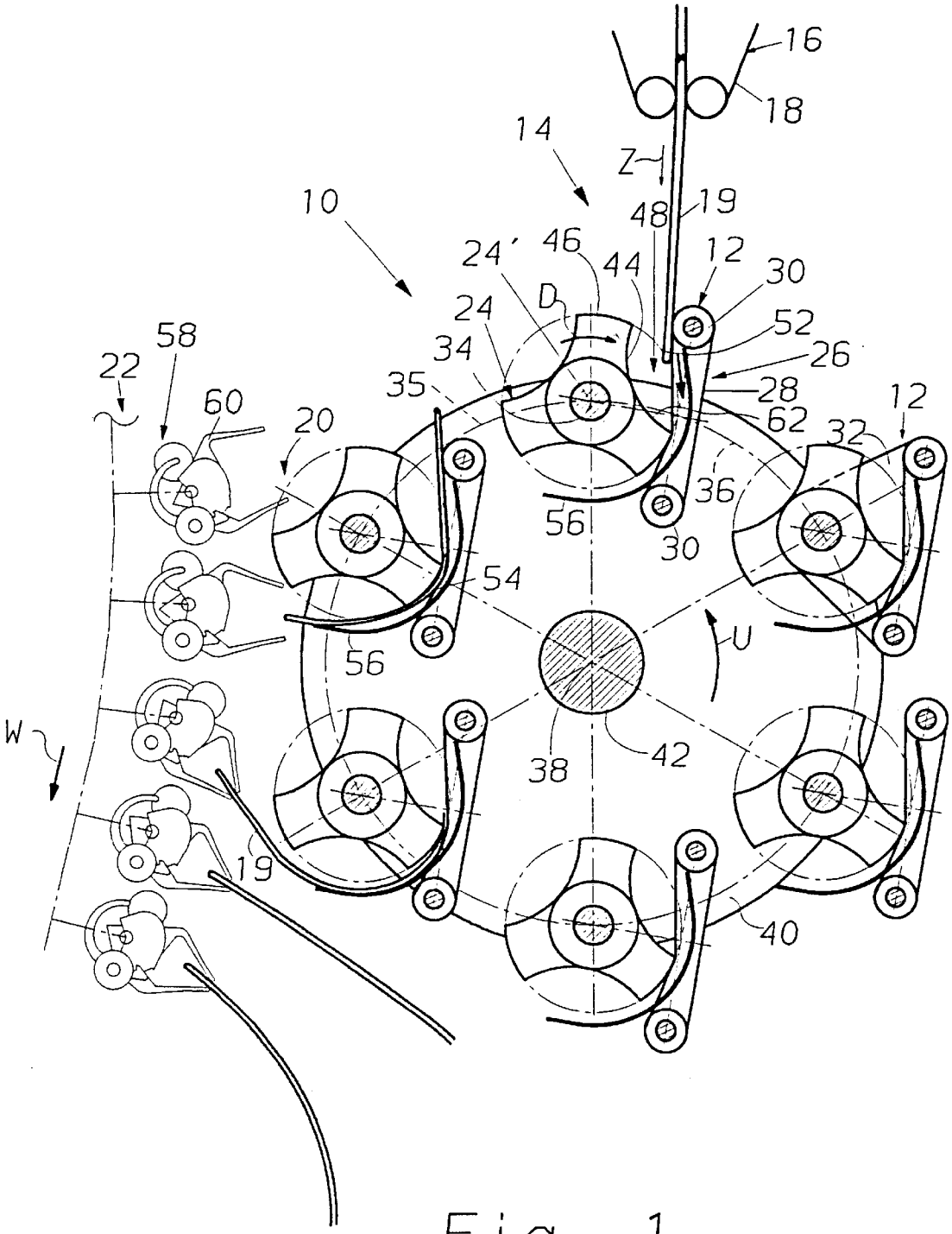
FIG. 1 is a view, partially in section, of a first embodiment of the apparatus, having conveying elements which, during circulation, maintain a mutually parallel position.

The apparatus illustrated in FIG. 1 has a conveying arrangement 10 which is designed in the manner of a drum, is driven continuously in the direction of the arrow U and has conveying elements 12 arranged in a cage-like manner. Said conveying elements are intended for receiving, during movement through a receiving region 14, in each case one flexible, sheet-like product 19 from a feed conveyor 18, which in the example shown is designed as a belt conveyor 16, for slowing down said product, conveying it further and transferring it, in a transfer region 20, to a removal conveyor 22, which is arranged downstream of the conveying arrangement 10.

Each conveying element 12 has a roller segment 24, which is driven such that it rotates continuously in a direction of rotation D—which is counter to the direction of circulation U—about its roller axis 24', and a mating element 26, which interacts with said roller segment. In the example shown, the mating element 26 is designed as an endless belt 28 which is guided around two deflecting rollers 30. The belt 28 is of elastomeric design and, by way of its active strand, which is directed toward the roller segment 24, interacts, between the deflecting rollers 30, with said roller segment.

The deflecting rollers are mounted in a freely rotatable manner at both ends on triangular carrier plates 32 which, for their part, are mounted in a freely rotatable manner on the shaft 34 of the roller segment 24. The carrier plates 32 are driven, for example, via a planet gear mechanism such that, during circulation along the circulatory path 35 formed by the circle 36, the conveying elements 12, which are formed by the belt 28 and roller segment 24, maintain a mutually parallel position or, in other words, the straight lines through the axes of the deflection rollers 30 assigned to a conveying element 12 remain parallel to other another. The shafts 34, which are coaxial with the roller axes 24', are distributed uniformly along a circle around a common axis of circulation 38 and are mounted in a freely rotatable manner on disc-like bearing plates 40 which, for their part, are seated in a rotationally fixed manner on a hollow shaft 42, which is coaxial with the axis of circulation 38. While one bearing plate 40 is assigned the drive means which are intended for keeping the conveying elements 12 parallel and are designed, for example, as planet gear mechanisms, the other bearing plate 40 is assigned the drive means which are intended for driving the roller segments 24 continuously in the direction of rotation D and are likewise designed, for example, as planet gear mechanisms. For this purpose, the hollow shaft 42 may have a rotationally fixed shaft engaging through it, the center wheels of the planet gear mechanisms being wedged onto said rotationally fixed shaft. During rotation of the bearing plates 40, the planet wheels, which are mounted on said bearing plates, mesh with the stationary center wheels and, for their part, act on the carrier plates 32 and/or shafts 34, are driven. It is also possible for the belts 28 to be driven, counter to the direction of rotation D, at the same time as the roller segments 24. As far as a possible embodiment of the drive for the roller segments 24 and mating elements 26 is concerned, and also for the purpose of keeping the conveying elements 12 parallel, reference is expressly made to CH Patent Application No. 1998 1283/98, which is incorporated herein by reference.

Each of the roller segments 24 shown in FIG. 1 has three recess sections 44 and, between in each case two recess sections 44, a circumferentially running lateral-surface section 46, which is coaxial with the roller-segment axis 24'. Each recess section 44, which is of concave design, is thus followed by a lateral-surface section 46. The cross section of the roller segment 24 is similar to a three-point star, of which the blunt points end on a circle.

The rotary position of the conveying elements 12 is selected such that, in the receiving region 14, the conveying elements 12 are arranged at least more or less in the radial direction in relation to the axis of circulation 38. Furthermore, the roller segments 24 are synchronized in relation to the bearing plates 40 such that, when a conveying element 12 moves into the receiving region 14 in the direction of circulation U, in each case one lateral-surface section 46 butts against the belt 28, and forces the latter back. The recess section 44 which follows the lateral-surface section 46 thus forms, together with the active strand of the belt 28, a wide, narrowing introduction gap 48 in which the feed conveyor 18 can introduce, without obstruction, a product 19 with the edge 52 leading, as seen in the feed direction Z. The rotation of the roller segment 24 means that, in the receiving region 14, the introduction gap 48, which is closed downstream, as seen in the direction of rotation D, becomes longer and longer and, at the same time, becomes narrower in the radially outward direction in relation to the roller axis 24'. The feed conveyor 18 and the conveying arrangement 10 are synchronized such that in each case the transition from the recess section 44 which bounds the introduction gap 48 into the following lateral-surface section 46 closes the introduction gap 48, with the product 19 which has been introduced into the introduction gap 48 being clamped firmly between it and the belt 28, in a region which is remote from the leading edge 52 at least more or less at that point in time at which the product 19 comes into abutment, by way of the leading edge 52, against the leading end region of the recess section 44, said end region acting as a stop 62, i.e. against the closed end of the introduction gap 48, and the lateral-surface section 46 forms, together with the belt 28, a conveying gap 54 for the gripped product 19.

Each roller segment 24 is assigned a guide element 56, which crosses the belt 28 downstream of the conveying gap 54 in order for the product conveyed through the conveying gap 54 to be deflected, around the roller segment 24, in the radially outward direction in relation to the axis of circulation 38.

In the example according to FIG. 1, the removal conveyor 22 is designed as a clamp-type transporter 58, of which the successive transporting clamps 60 are moved, synchronously with the conveying elements 12, through the transfer region 20 in the removal direction W—which in this case is oriented in the same direction as the direction of circulation U. In this case, the transporting clamps 60 are directed toward the conveying arrangement 10 in order that the radially outwardly deflected products 19 can be conveyed by the conveying elements 12 into the transporting clamps 60 with the edge 52 in front. The transporting clamps 60 are closed approximately at the same time as the conveying gap 54 is eliminated, in that the last lateral-surface section 46, which bounds a conveying gap 54 for the relevant product 19, runs off the belt 28.

In the example shown, during one revolution of the bearing plates 40 in the direction of circulation U about the axis of circulation 38, the roller segments 24 rotate twice about their roller axes 24' in the opposite direction of rotation D, and thus three times in relation to the bearing plates 40.

Figure 2:
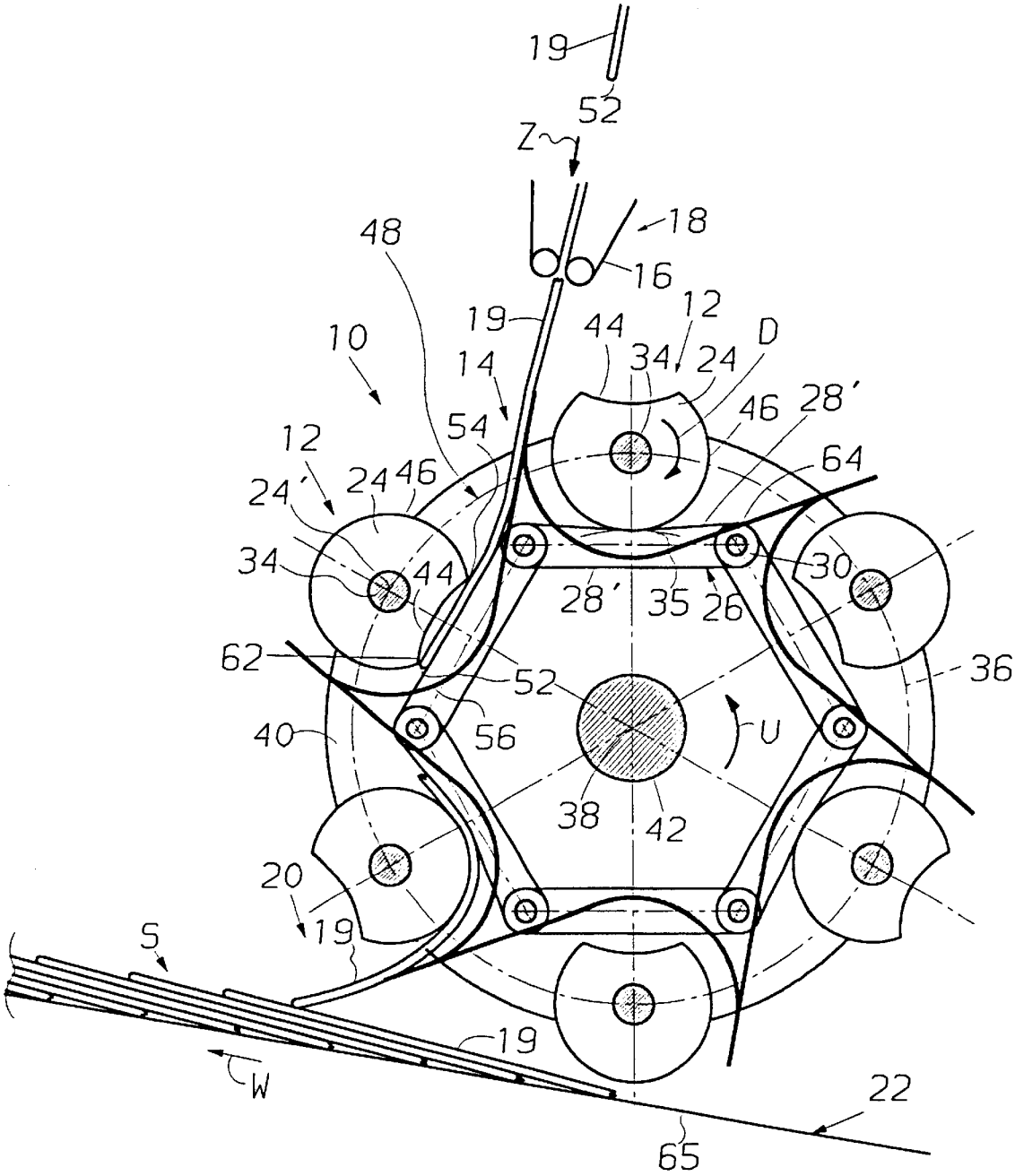
FIG. 2 shows, in the same illustration as FIG. 1, a second embodiment, in the case of which, during circulation, the conveying elements maintain an unaltered position in relation to the circulatory path.

In the case of that embodiment of the apparatus which is shown in FIG. 2, the conveying arrangement 10 is likewise designed in a cage-like manner. Arranged on the bearing plates 40, which are arranged on the hollow shaft 42, are six bearing shafts 64, which are parallel to the axis of circulation 38, distributed uniformly along a coaxial circle. Deflecting rollers 30 are mounted in a freely rotatable manner on the bearing shafts 64. In each case two mutually associated deflecting rollers 30 of adjacent bearing shafts 64 have a continuous elastomeric belt 28' gripping around them. A plurality of tapes 28' arranged one beside the other correspond to the belt 28 of the embodiment shown in FIG. 1. The roller segments 24 are distributed uniformly on the circle 36 around the axis of circulation 38. They are seated on the shafts 34, which, as seen in the direction of circulation U, are mounted on the bearing plates 40, centrally between in each case two bearing shafts 64 and radially outside the tapes 28'. The roller segments 24, in turn, are driven continuously in the direction of rotation D, which is counter to the direction of circulation U, for example by means of a planet gear mechanism.

Each roller segment 24 has a recess section 44, which is of concave design. The distance between the tape 28' and the shafts 34 is selected such that, with the recess section 44 directed toward the relevant tape 28, the roller segment 24 butts, by way of the two transitions from the recess section 44 to the lateral-surface section 46, against the tape 28'—if there is no product 19 there—and, if appropriate, forces said tape back. In any case, the tape is forced back when it interacts with the lateral-surface section 46.

Each roller segment 24 is assigned a guide element 56 which runs through between adjacent tapes 28' and engages around the relevant roller segment 24 at a distance therefrom. Downstream of the associated roller segment 24, as seen in the direction of circulation U of the conveying arrangement 10, the guide element 56 runs coaxially with the roller axis 24' and ends approximately 30° in front of a radial line through the roller axis from the axis of circulation 38. Upstream of the roller segment 24, the guide element 56 runs approximately in a straight line and forms a tangent to the downstream, radially outwardly directed section of the guide element 56 assigned to the following roller segment 24.

The feed conveyor 18, which is likewise designed as a belt conveyor 16, is aligned at least more or less with the upstream, straight-line section of the guide element 56 when the latter is moved past the end of the feed conveyor 18 in the receiving region 14.

The roller segments 24 are driven such that, during movement past the feed conveyor 18 in the direction of the arrow U, they butt against the tape 28' by way of the lateral-surface section 46. As soon as they have been moved past the feed conveyor 18, the latter introduces in each case one product 19, with the edge 52 in front, between the relevant roller segment 24 and the trailing section of the associated guide element 56. As a result of the rotation of the roller segment 24, the leading end of the recess section 44 has reached the tape 28' and forms, together with the latter, the introduction gap 48, into which the product 19 can be introduced, with play, with the edge 52 in front. The leading end region of the recess section 44, in turn, forms the stop 62 for the leading edge 52. At least more or less at the same time as the leading edge 52 comes into contact with the stop 62, the trailing end of the recess section 44, as seen in the direction of rotation D, and the start of the lateral-surface section 46 run onto that flat side of the product 19 which is located opposite the tape 28' and clamp said product firmly, and the lateral-surface section 46 forms, with the tape 28', the conveying gap 54.

The removal conveyor 22, which is designed as a belt conveyor 65, is arranged beneath the conveying arrangement 10. The removal direction W is counter to the direction of circulation U in the transfer region 20. The products 19 conveyed through the conveying gap 54 with the edge 52 in front are deflected by means of the guide elements 56 and then deposited, in the transfer region 20, on the removal conveyor 22, an imbricated formation S being formed in the process. The speed of circulation of the roller segments 24, and thus of the conveying elements 12, about the axis of circulation 38, the circumferential speed of the roller segments 24 and the speed of the removal conveyor 22 are coordinated with one another such that, during release from the conveyor gap 54, the speed of the leading edge 52 in the removal direction W corresponds at least more or less to the conveying speed of the removal conveyor 22. This makes it possible to form a precise imbricated formation.

The conveying elements 12, which are formed by the roller segments 24 and associated tapes 28', maintain their position in relation to their circulatory path 35.

Figure 3:
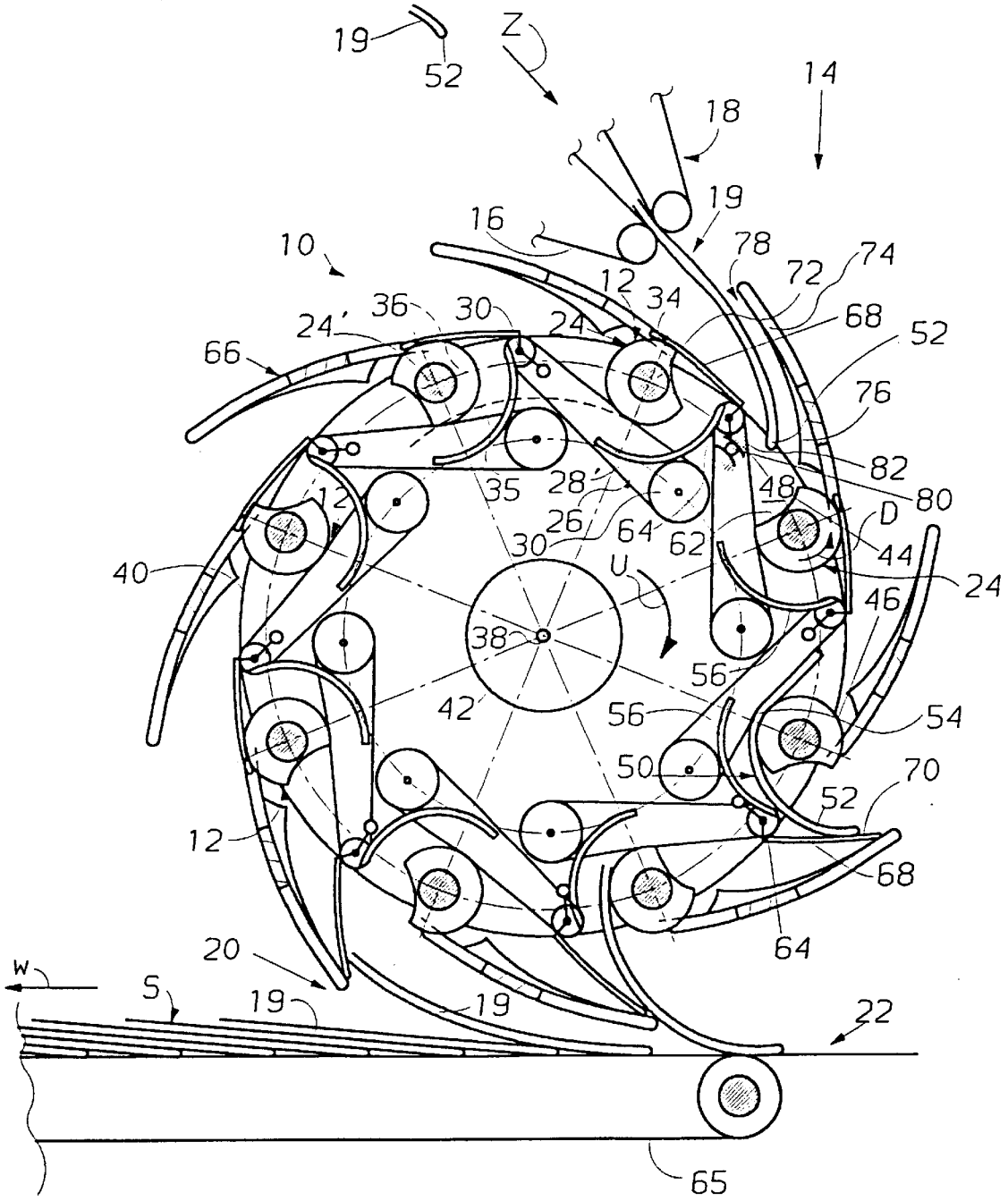
FIG. 3 shows, in the same illustration as FIGS. 1 and 2, a third embodiment of the apparatus, with directing elements which are assigned to the conveying elements and which are arranged in the manner of a paddle wheel.

In the case of that embodiment of the apparatus which is shown in FIG. 3, the conveying arrangement 10 is designed in the manner of a paddle wheel 66. Paddle wheels 66 are used, for example, in rotary printing machines for delivering the folded products 19. In the same way as in the case of the embodiment shown in FIG. 2, the roller segments 24 are mounted on the bearing plates 40 and, during rotation of the bearing plates about the common axis of circulation 38 in the direction of circulation U, are driven continuously in the opposite direction D. The mating element 26 for each roller element 24, in turn, is formed by tapes 28' which are guided around deflection rollers 30. The deflection rollers 30 which follow the roller segment 24, as seen in the direction of circulation U, are arranged further outward in the radial direction, in relation to the axis of circulation 38, than the leading deflection rollers 30. The mating element 26, which maintains its position in relation to the circulatory path, is thus arranged in an inclined manner in relation to the circulatory path.

Each roller segment 24, in turn, is assigned a guide element 56 which crosses the tape 28' downstream of the conveying gap 54, as seen in the direction of rotation D of the roller segments 24, and runs in the radially outward direction in order for the products 19 conveyed through the conveying gap 54 to be deflected, around the roller segment 24, in the radially outward direction. The guide element 56 ends at the trailing deflection rollers 30, as seen in the direction of circulation U, of the respectively preceding conveying element 12. Mounted on the bearing shaft 64 of said deflecting rollers 30, furthermore, is a directing-element section 68 which can be changed over from a guide-element position 70, in which it forms an extension of the guide element 56 in order for the product 19 conveyed in the conveying gap 54 to be deflected in the radially rearward direction, into a directing-element position 72. In the directing-element position 72, the directing-element section 68 forms a tangent, by way of its free end, to the periphery of the following roller segment 24. For this purpose, the roller segment 24 is formed by axially spaced-apart roller-segment elements, between which the tines of the rake-like directing-element section 68 can engage.

In the directing-element position 72, the directing-element section 68 is aligned with a directing element 74, which is assigned to each roller segment 24. Said directing element is arranged firmly on the bearing plates 40 and starting from its leading end, which is located at the roller segment 24, runs rearwardly counter to the direction of circulation U, with the distance from the axis of circulation 38 increasing, to the following roller segment 24, from which it is spaced apart in the radial direction.

Respectively adjacent directing elements 74 form, with the appropriate directing-element section 68 and the mating element 26, a pocket 78 which, as seen in the direction of circulation U, is open to the recess and is closed at the front by means of the appropriate roller segment 24.

The feed conveyor 18, which in turn is designed as a belt conveyor 16, is arranged above the conveying arrangement 10, and its conveying direction Z is aligned with the pocket 78 moved past it in each case. The feed conveyor 18 is intended for introducing a product 19 with the edge 52 in front into each pocket 78 moved past it.

A lever projects from each directing-element section 68, and a rolling element 80 is mounted in a freely rotatable manner at the free end of said lever. Said rolling element is guided in a stationary, groove-like guide 82 which runs around the axis of circulation 38. By means of this guide control, the directing-element section 68 is changed over between the guide-element position 70 and the directing-element position 72. In the receiving region 14, the directing-element section 68 is located in the directing-element position 72 and together with the directing element 76, which is located on the outside in the radial direction, bounds an introduction gap for the product 19. In the receiving region 14, the concave recess section 44 of the roller segment 24 forms, with the associated tapes 28', the narrowing introduction gap 48, the directing element 76 being intended for directing the leading edge 52 into the recess section 44. The leading end region of the recess section 44, as seen in the direction of rotation D, in turn forms the stop 62 for the leading edge 52 of the product 19. The rotation of the roller segment 24 in the direction D is, in turn, synchronized such that the trailing end of the recess section 44, and thus the leading end of the lateral-surface section 46, come into abutment against the flat side of the product 19 and clamp the latter firmly with the mating element 26, approximately at the same time as the leading edge 52 comes into abutment against the stop 62. As a result of the continuous further rotation of the roller segment 24, the product 19 is then conveyed through the conveying gap 54 with the edge 52 in front and by means of the guide element 56 and the directing-element section 68 assigned thereto, which in the meantime has been changed over into the guide-element position 70, is deflected, around the roller segment 24, in the radially outward direction and in the rearward direction in relation to the direction of circulation U.

The removal conveyor 22, which is designed as a belt conveyor 65, in turn runs beneath the conveying arrangement 10, and its removal direction W is oriented in the same direction as the direction of circulation U in the transfer region 20. In the transfer region 20, the products 19 are conveyed out of the conveying gap 54 and deposited on the removal conveyor 22, an imbricated formation S being formed in the process. The inertia of the products 19 causes the latter, following release from the conveying gap 54, to slide out of the gap formed by the roller segment 24, guide element 56 and directing-element section 68; the speed of circulation of the conveying elements 12, the axis of circulation 38 and the circumferential speed of the roller segments 24 as well as the conveying speed of the removal conveyor 22 are coordinated with one another such that in the transfer region, as seen in the removal direction W, the products 19 which are to be transferred from the conveying arrangement 10 to the removal conveyor 22 are approximately at a standstill in relation to the active strand of said conveyor. It is also conceivable to arrange in the transfer region 20 additional known guides or conveying elements, such as chains or rollers, for conveying the products 19 precisely out of the gap.

Once they have left the transfer region 20, the directing-element sections 68 are changed over from the guide-element position 70 into the directing-element position 72.

In the case of all the embodiments shown, the products 19 are fed to the receiving region 14 at a distance one behind the other by means of the feed conveyor 18. The feed conveyor 18 may be, for example, part of a folding or cutting arrangement of a rotary printing machine.

It is possible, in the case of the embodiment shown in FIG. 1, for the clamp-type transporter 58 to be replaced by a different transporting arrangement, for example a belt conveyor. It is also conceivable, in the case of the embodiments shown in FIGS. 2 and 3, for the removal conveyor 22 to be designed as a clamp-type transporter 58.

Depending on the removal direction W of the removal conveyor 22, it is possible to form, in the transfer region 20, an imbricated formation S in which the leading edge 52 in the conveying arrangement 10 is trailing or leading in relation to the removal direction W.

Common to all the embodiments is the fact that the products 19 are introduced in a closed introduction gap 48, decelerated there and conveyed through the conveying element 12. It is thus not necessary at any time for them to be slowed down to a standstill in relation to the conveying arrangement 10, which ensures careful handling along with a high processing capacity. Furthermore, the products 19 are not subjected to any abrupt changes in direction.

The mating elements 26 may be designed differently; they may thus have rollers arranged, for example, in a resilient manner.

That which is claimed:

1. An apparatus for processing flexible, sheet-like products by slowing down the products which are delivered to a receiving region of the apparatus from a feed conveyor and then conveying the received products to a transfer region of the apparatus, and comprising a plurality of conveying elements arranged in a circular array one behind the other on a support member, a drive for rotating the support member about a central axis such that the conveying elements each move along a circulatory path from a receiving region to a transfer region, each conveying element comprising a roller segment mounted to the support member for rotation about a rotational axis which is parallel to the central axis, and a mating element, and with the periphery of the roller segment including at least one circumferentially running surface section and at least one recess section, said drive including means for rotating the roller segment of each conveying element about its rotational axis while the support member rotates about said central axis, and such that (1) during movement of each conveying element through the receiving region the recess section of the roller segment and the mating element form an introduction gap therebetween which is closed at a downstream end of the gap as seen in the direction of rotation of the roller segment, for receiving a product fed from a feed conveyor, and (2) during subsequent movement and at about the time at which a leading end of the product reaches the closed end of the introduction gap the circumferentially running surface section of the roller segment and the mating element form a conveying gap for engaging the received product and conveying the same from the receiving region to the transfer region.

2. The apparatus as claimed in claim 1 wherein the mating element of each conveying element includes an endless belt which is guided around deflecting rollers and interacts, between the deflecting rollers, with the roller segment.

3. The apparatus as claimed in claim 1 wherein the cross section of the roller segment in the recess section is concave.

4. The apparatus as claimed in claim 1 wherein the closed end of the introduction gap is defined by a stop formed by a leading end section of the recess section which is engaged by the leading edge of the relevant product introduced into the introduction gap in the receiving region.

5. The apparatus as claimed in claim 1 wherein, during circulation, the conveying elements maintain a mutually parallel position.

6. The apparatus as claimed in claim 1 further comprising a clamp type transporter positioned adjacent the transfer region, said clamp type transporter having transporting clamps for respectively receiving products from the conveying elements.

7. The apparatus as claimed in claim 1 further comprising a belt conveyor positioned adjacent the transfer region for respectively receiving products from the conveying elements.

8. The apparatus as claimed in claim 1 wherein, during circulation, the conveying elements maintain a generally unaltered position in relation to the circulatory path.

9. The apparatus as claimed in claim 8 wherein the introduction gap and conveying gap extend generally in the direction of the circulatory path.

10. The apparatus as claimed in claim 8 wherein the conveying elements are respectively assigned directing elements which are arranged in the manner of a paddle wheel.

11. The apparatus as claimed in claim 1 wherein each roller segment is assigned a guide element which is configured to deflect the product around the roller segment downstream of the conveying gap.

12. The apparatus as claimed in claim 11 wherein each conveying element further comprises a directing element mounted to the support member adjacent the associated roller segment and which includes a trailing portion which extends rearwardly from the associated roller segment with respect to the rotational direction of the support member and radially outwardly from the central axis.

13. The apparatus as claimed in claim 12 wherein each conveying element further comprises a directing element section pivotally mounted to the support member for pivotal movement between a directing-element position which is in general alignment with the directing element so as to form therebetween a rearward extension of the introduction gap, and a guide-element position so as to form a generally radially extending extension of the guide element.

14. The apparatus as claimed in claim 13 further comprising a guide for pivoting the directing element section between said directing-element position and said guide element position, and such that the directing element section is in the directing-element position during movement through the receiving region of the apparatus and in the guide-element position during movement through the transfer region of the apparatus.

* * * * *